US010370792B2

(12) United States Patent
Jariwala et al.

(10) Patent No.: US 10,370,792 B2
(45) Date of Patent: Aug. 6, 2019

(54) SURFACTANT-CONTAINING FLUOROCHEMICAL COMPOSITIONS, ARTICLES, AND METHODS

(71) Applicant: 3M INNOVATIVE PROPERTIES COMPANY, St. Paul, MN (US)

(72) Inventors: Chetan P. Jariwala, Woodbury, MN (US); Dirk M. Coppens, Beveren (BE); Rudolph J. Dams, Antwerp (BE)

(73) Assignee: 3M iNNOVATIVE PROPERTIES COMPANY, St. Paul, MN (US)

( * ) Notice: Subject to any disclaimer, the term of this patent is extended or adjusted under 35 U.S.C. 154(b) by 555 days.

(21) Appl. No.: 14/390,844

(22) PCT Filed: Mar. 6, 2013

(86) PCT No.: PCT/US2013/029265
§ 371 (c)(1),
(2) Date: Oct. 6, 2014

(87) PCT Pub. No.: WO2013/162705
PCT Pub. Date: Oct. 31, 2013

(65) Prior Publication Data

US 2015/0118930 A1 Apr. 30, 2015

Related U.S. Application Data

(60) Provisional application No. 61/656,740, filed on Jun. 7, 2012, provisional application No. 61/637,680, filed on Apr. 24, 2012.

(51) Int. Cl.

| | |
|---|---|
| ***D06M 13/46*** | (2006.01) |
| ***D06M 101/32*** | (2006.01) |
| ***D06M 101/34*** | (2006.01) |
| ***D06M 13/463*** | (2006.01) |
| ***D06M 15/256*** | (2006.01) |
| ***D06M 15/277*** | (2006.01) |
| ***D06M 15/295*** | (2006.01) |
| ***D06M 15/353*** | (2006.01) |
| ***D06M 15/576*** | (2006.01) |

(52) U.S. Cl.
CPC ..... *D06M 13/463* (2013.01); *D06M 13/46* (2013.01); *D06M 15/256* (2013.01); *D06M 15/277* (2013.01); *D06M 15/295* (2013.01); *D06M 15/353* (2013.01); *D06M 15/576* (2013.01); *D06M 2101/32* (2013.01); *D06M 2101/34* (2013.01); *D06M 2200/12* (2013.01); *Y10T 442/2189* (2015.04)

(58) Field of Classification Search
CPC . C08K 5/17; C08K 5/175; C08K 5/18; C08K 5/19; C11D 1/62; C11D 1/64; C11D 1/46; C11D 3/30; C07C 211/62; C07C 211/63; C07C 211/64; C07C 213/06; C07C 213/08; C07C 215/40; C07C 219/08; D06M 13/46; D06M 13/461; D06M 13/463; D06M 13/467; D06M 13/47; D06M 13/473; D06M 13/477; D06M 13/48; D06M 15/256; D06M 15/277; D06M 15/295; D06M 15/353; D06M 15/576; Y10T 442/20; Y10T 442/2189; Y10T 442/2238; Y10T 442/227; Y10T 442/2287; Y10T 442/232
USPC ..... 510/504, 329, 330, 331; 554/103–113, 554/52; 528/401, 402; 526/242–255; 525/199, 200, 276, 326.2, 326.3, 326.4; 524/462, 463, 520, 544, 545, 546, 795, 524/805; 442/59, 82, 88, 92, 94, 98
See application file for complete search history.

(56) References Cited

U.S. PATENT DOCUMENTS

| | | | | |
|---|---|---|---|---|
| 5,910,557 | A | 6/1999 | Audenaert | |
| 6,075,003 | A | 6/2000 | Haq | |
| 6,162,369 | A | 12/2000 | Allewaert | |
| 6,224,782 | B1 | 5/2001 | Allewaert | |
| 6,239,247 | B1 * | 5/2001 | Allewaert | C08G 18/4063 106/2 |
| 6,664,354 | B2 | 12/2003 | Savu | |
| 6,803,109 | B2 | 10/2004 | Qiu | |
| 7,750,093 | B2 | 7/2010 | Elsbernd | |
| 7,807,614 | B2 | 10/2010 | Bigorra Llosas | |
| 7,893,014 | B2 | 2/2011 | van Buskirk | |
| 9,365,714 | B2 | 6/2016 | Uesugi | |
| 2005/0113508 | A1 * | 5/2005 | Jariwala | C08G 18/6279 524/556 |
| 2007/0012895 | A1 | 1/2007 | Sandner | |
| 2008/0119383 | A1 | 5/2008 | Boardman et al. | |
| 2008/0148491 | A1 | 6/2008 | van Buskirk | |
| 2008/0306238 | A1 | 12/2008 | Jariwala | |
| 2009/0074975 | A1 * | 3/2009 | Jariwala | B01F 17/0035 427/355 |
| 2010/0173085 | A1 * | 7/2010 | Jariwala | C08G 63/6826 427/385.5 |
| 2010/0227148 | A1 | 9/2010 | Jariwala | |

(Continued)

FOREIGN PATENT DOCUMENTS

| | | | |
|---|---|---|---|
| DE | 10251856 | 5/2004 | |
| EP | 1149897 A1 * | 10/2001 | C11D 17/0073 |

(Continued)

OTHER PUBLICATIONS

DOW; TERGITOL™ TMN-6 (90%) Surfactant Product Information; accessed Jan. 24, 2017; http://www.dow.com/assets/attachments/business/pcm/tergitol/tergitol_tmn-6_90/tds/tergitol_tmn-6_90tds.pdf.*
Scifinder, "Zonyl 8300".*
Solans, Current Opinion in Colloid & Interface Science 10 (2005) 102-110, Aug. 30, 2005.*
Gupta, Soft Matter, 12, 2826-2841 Feb. 23, 2016.*

(Continued)

*Primary Examiner* — Lynda Salvatore

(57) ABSTRACT

A fluorochemical composition comprising: at least one fluorinated compound; and at least one esterquat or amidequat surfactant.

30 Claims, No Drawings

(56) References Cited

U.S. PATENT DOCUMENTS

| | | | | |
|---|---|---|---|---|
| 2011/0062294 | A1 | 3/2011 | Johnson | |
| 2015/0038037 | A1* | 2/2015 | Coppens | C08G 18/6279 442/164 |

FOREIGN PATENT DOCUMENTS

| | | |
|---|---|---|
| EP | 1359212 | 11/2003 |
| WO | WO 1991-01295 | 2/1991 |
| WO | WO 1998-41602 | 9/1998 |
| WO | WO 2002-36873 | 5/2002 |
| WO | WO 2008-154421 | 12/2008 |
| WO | WO 2011-062294 | 5/2011 |

OTHER PUBLICATIONS

International Search Report for PCT International Application No. PCT/US2013/029265, dated Jun. 21, 2013, 4pgs.

Dams et al., Chapter 1, "Industrial Aspects of Fluorinated Oligomers and Polymers" in *Fluorinated Polymers vol. 2: Applications*, Ameduri et al. (Ed.), Royal Society of Chemistry, Cambridge, UK, 2017, Cover page, publisher's pages, table of contents, pp. 12-13, and pp. 27-31.

Chapter 12, "Fluorinated Repellents" in *Fluorinated Surfactants and Repellents, Second Edition Revised and Expanded*, Kissa (consultant), Marcel Dekker, Inc., New York, NY, 2001. Cover page, publisher's pages, table of contents, pp. 530-556.

Chapter 13, "Fluorinated Soil Retardants" in *Fluorinated Surfactants and Repellents, Second Edition Revised and Expanded*, Kissa (consultant), Marcel Dekker, Inc., New York, NY, 2001. Cover page, publisher's pages, table of contents, pp. 574-581.

* cited by examiner

SURFACTANT-CONTAINING FLUOROCHEMICAL COMPOSITIONS, ARTICLES, AND METHODS

BACKGROUND

Repellent fluorochemical treatment compositions based on C4-fluorochemistry have been in use over the past few years. Many commercially available products require complex chemistry, resulting in processing and production issues and high manufacturing costs.

It is known that some $C_4F_9$- and $C_6F_{13}$-based fluoromaterials do not perform as well as their $C_8F_{17}$-based counterparts. Specifically, the dynaminc water repellency is poor compared to $C_8F_{17}$-based products. Therefore, there is a need in the industry to improve performance of the $C_4F_9$- and $C_6F_{13}$-based fluoromaterials without requiring complex chemistry and/or processing.

SUMMARY

The present disclosure provides fluorochemical compositions that can include one or more fluorinated compounds and one or more esterquat or amidequat surfactants. Such fluorochemical compositions can be used to treat fibrous substrates, especially synthetic textiles such as polyester and nylon, to impart one or more repellency characteristics (e.g., water repellency) to such substrate.

In certain embodiments, the present disclosure provides a fluorochemical composition comprising:

at least one fluorinated compound; and greater than 3 wt-%, based on fluorinated solids, of at least one surfactant having the following Formula I:

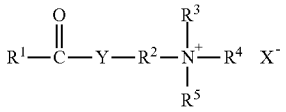

wherein:

each $R^1$ is independently a long chain, linear or branched, saturated or unsaturated, aliphatic group having 6 to 24 carbon atoms (in certain embodiments $R^1$ is saturated, and in certain embodiments $R^1$ includes 1, 2, or 3 unsaturated carbon-carbon bonds), or mixtures thereof;

each $R^2$ is independently a divalent alkylene group having 1 to 4 carbon atoms;

$R^3$ is an alkyl group having 1 to 4 carbon atoms;

$R^4$ and $R^5$ are each independently —$CH_2C(O)OH$, —$CH_2CH_2OH$, —$(R^2O)_n$—H, an alkyl group having 1 to 4 carbon atoms, or —$R^2$—Y—C(O)—$R^1$, with the proviso that only one of $R^4$ or $R^5$ can be —$R^2$—Y—C(O)—$R^1$ in any one compound;

each Y is independently O or NH;

n is 1-10; and $X^-$ is an anion.

In certain embodiments, the present disclosure provides a fluorochemical composition comprising:

at least one fluorinated compound; and greater than 3 wt-% by weight, based on fluorochemical solids, of at least one surfactant having the following Formula II:

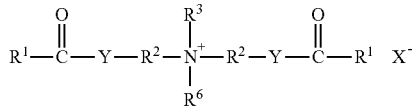

wherein:

each $R^1$ is independently a long chain, linear or branched, saturated or unsaturated, aliphatic group having 6 to 24 carbon atoms (in certain embodiments $R^1$ is saturated, and in certain embodiments $R^1$ includes 1, 2, or 3 unsaturated carbon-carbon bonds) or mixtures thereof;

each $R^2$ is independently a divalent alkylene group having 1 to 4 carbon atoms;

$R^3$ is an alkyl group having 1 to 4 carbon atoms;

$R^6$ is an alkyl group having 1 to 4 carbon atoms or —$(R^2O)_n$—H (preferably an alkyl group having 1 to 4 carbon atoms);

each Y is independently O or NH;

n is 1-10; and $X^-$ is an anion.

In certain embodiments, the present disclosure provides a fluorochemical composition comprising:

at least one fluorinated compound; and at least one surfactant having Formula I;

with the proviso that no nonionic surfactants are present in the composition.

In certain embodiments, the present disclosure provides a fluorochemical composition comprising:

at least one fluorinated compound; and at least one surfactant having Formula II;

with the proviso that no nonionic surfactants are present in the composition.

In certain embodiments, the fluorochemical composition of the present disclosure includes the surfactant of Formula I or II as the only surfactant present in the composition.

In certain embodiments, the present disclosure provides a method of imparting repellency to a fibrous substrate having one or more surfaces, the method comprising: applying a fluorochemical treatment composition onto one or more surfaces of the fibrous substrate; and curing the fluorochemical treatment composition; wherein the fluorochemical treatment composition comprises a fluorochemical composition as described herein. In certain embodiments, the present disclosure provides an article comprising: a fibrous substrate having one or more surfaces treated according to this method.

The terms "comprises" and variations thereof do not have a limiting meaning where these terms appear in the description and claims.

The words "preferred" and "preferably" refer to embodiments of the disclosure that may afford certain benefits, under certain circumstances. However, other embodiments may also be preferred, under the same or other circumstances. Furthermore, the recitation of one or more preferred embodiments does not imply that other embodiments are not useful, and is not intended to exclude other embodiments from the scope of the disclosure.

In this application, terms such as "a," "an," and "the" are not intended to refer to only a singular entity, but include the general class of which a specific example may be used for illustration. The terms "a," "an," and "the" are used interchangeably with the term "at least one." The phrases "at least one of" and "comprises at least one of" followed by a list refers to any one of the items in the list and any combination of two or more items in the list.

As used herein, the term "or" is generally employed in its usual sense including "and/or" unless the content clearly dictates otherwise.

The term "and/or" means one or all of the listed elements or a combination of any two or more of the listed elements.

Also herein, all numbers are assumed to be modified by the term "about" and preferably by the term "exactly." As used herein in connection with a measured quantity, the term "about" refers to that variation in the measured quantity as would be expected by the skilled artisan making the measurement and exercising a level of care commensurate with the objective of the measurement and the precision of the measuring equipment used.

Also herein, the recitations of numerical ranges by endpoints include all numbers subsumed within that range as well as the endpoints (e.g., 1 to 5 includes 1, 1.5, 2, 2.75, 3, 3.80, 4, 5, etc.).

When a group is present more than once in a formula described herein, each group is "independently" selected, whether specifically stated or not. For example, when more than one $R^1$ group is present in a formula, each $R^1$ group is independently selected. Furthermore, subgroups contained within these groups are also independently selected.

As used herein, the term "room temperature" refers to a temperature of about 20° C. to about 25° C. or about 22° C. to about 25° C.

The above summary of the present disclosure is not intended to describe each disclosed embodiment or every implementation of the present disclosure. The description that follows more particularly exemplifies illustrative embodiments. In several places throughout the application, guidance is provided through lists of examples, which examples can be used in various combinations. In each instance, the recited list serves only as a representative group and should not be interpreted as an exclusive list.

DETAILED DESCRIPTION OF EXEMPLARY EMBODIMENTS

The present disclosure provides fluorochemical compositions that include one or more fluorinated compounds and one or more esterquat or amidequat surfactants useful to treat fibrous substrates, e.g., to impart one or more repellency characteristics (e.g., water repellency) to such substrate.

Such advantageous repellency characteristics result because of the unique properties of a surfactant of the present disclosure when used in combination with one or more fluorinated compounds, particularly those having terminal perfluorinated aliphatic groups with 4 to 6 carbon atoms, such as $C_4F_9$- and $C_6F_{13}$-containing compounds.

At least one of the surfactants incorporated into a fluorochemical composition of the present disclosure is an esterquat or an amidequat. "Esterquats" are generally understood to be quaternized amine fatty acid ester salts (containing an ester linking group). These are known substances which may be obtained by the relevant methods of preparative organic chemistry, e.g., International Patent Application No. WO 91/01295 (Henkel). According to this document, for example, triethanolamine is partly esterified with fatty acids in the presence of hypophosphorous acid, air is passed through and the reaction product is quatemized with dimethyl sulfate or ethylene oxide. Sources of esterquats include, for example, Stepan Company and Akzo Nobel.

"Amidequats" are generally understood to be quaternized amine fatty acid amide salts (containing an amide linking group). These are known substances which may be obtained by the relevant methods of preparative organic chemistry. Sources of amidquats include, for example, Stepan Company and Akzo Nobel.

In certain embodiments, the surfactants of the present disclosure are preferably of the following formula (Formula I):

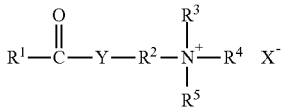

wherein:

each $R^1$ is independently a long chain, linear or branched, saturated or unsaturated, aliphatic group having 6 to 24 carbon atoms (in certain embodiments $R^1$ is saturated, and in certain embodiments $R^1$ includes 1, 2, or 3 unsaturated carbon-carbon bonds), or mixtures thereof;

each $R^2$ is independently a divalent alkylene group having 1 to 4 carbon atoms;

$R^3$ is an alkyl group having 1 to 4 carbon atoms;

$R^4$ and $R^5$ are each independently —$CH_2C(O)OH$, —$CH_2CH_2OH$, —$(R^2O)_n$—H, an alkyl group having 1 to 4 carbon atoms, or —$R^2$—Y—C(O)—$R^1$, with the proviso that only one of $R^4$ or $R^5$ can be —$R^2$—Y—C(O)—$R^1$ in any one compound;

each Y is independently O or NH;

n is 1-10; and $X^-$ is an anion.

In certain embodiments, the surfactants of the present disclosure are preferably of the following formula (Formula II):

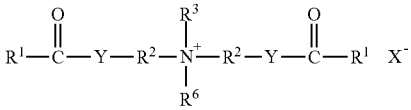

wherein:

each $R^1$ is independently a long chain, linear or branched, saturated or unsaturated, aliphatic group having 6 to 24 carbon atoms (in certain embodiments $R^1$ is saturated, and in certain embodiments $R^1$ includes 1, 2, or 3 unsaturated carbon-carbon bonds) or mixtures thereof;

each $R^2$ is independently a divalent alkylene group having 1 to 4 carbon atoms;

$R^3$ is an alkyl group having 1 to 4 carbon atoms;

$R^6$ is an alkyl group having 1 to 4 carbon atoms or —$(R^2O)_n$—H (preferably an alkyl group having 1 to 4 carbon atoms);

each Y is independently O or NH;

n is 1-10; and $X^-$ is an anion.

Preferred esterquats within the scope of the compounds of Formula II are of the following formula (Formula III):

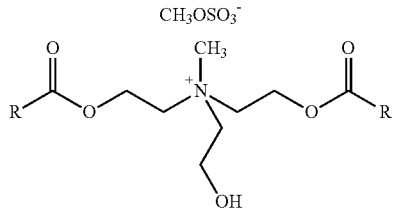

R = Tallow wherein "tallow" corresponds to mixtures of aliphatic tails containing saturated C16 to C20 chains and C18 mono- or di-unsaturated chains. In certain embodiments, the composition of the aliphatic tails is derived from a mixture of fatty acids that is typically as follows: saturated fatty acids (palmitic acid, stearic acid, and myristic acid); monounsaturated fatty acids (oleic acid and palmitoleic acid); and polyunsaturated fatty acids (linoleic acid and linolenic acid). Such materials are available from Stepan Company.

Another preferred esterquat within the scope of Formula II is of the following formula: $(R^7C(O)OCH_2CH_2)_2$—$N(CH_3)_2^+Cl^-$ wherein $R^7$ is a C12-C18 aliphatic chain. Such materials are available from Akzo Nobel as is available, for example, under the trade name ARMOCARE VGH-70.

Preferred amidequats within the scope of the compounds of Formula II are of the following formula (Formula IV):

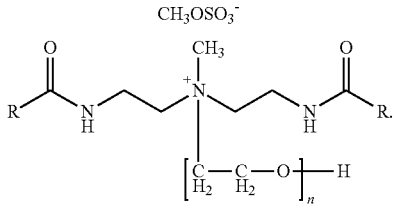

R = Hydrogenated Tallow
n = 1 to 10 wherein "hydrogenated tallow" corresponds to a mixture of saturated fatty acid chains corresponding to the hydrogenated analogue of the "tallow" chains mentioned above.

In certain embodiments, the surfactants of the present disclosure are preferably of the following formula (Formula V):

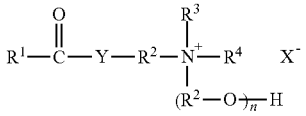

wherein:

each $R^1$ is independently a long chain, linear or branched, saturated or unsaturated, aliphatic group having 6 to 24 carbon atoms (in certain embodiments $R^1$ is saturated, and in certain embodiments $R^1$ includes 1, 2, or 3 unsaturated carbon-carbon bonds), or mixtures thereof;

$R^2$ is a divalent alkylene group having 1 to 4 carbon atoms;

$R^3$ is an alkyl group having 1 to 4 carbon atoms;

$R^4$ is —$CH_2C(O)OH$, —$CH_2CH_2OH$, —$CH_2CH_2OCH_2CH_2OH$, or an alkyl group having 1 to 4 carbon atoms;

each Y is NH;

n is 2; and $X^-$ is an anion.

Preferred amidequats within the scope of the compounds of Formula V are those described in U.S. Pat. No. 7,807,614, and in particular Example P2.

In the surfactants described above, in certain embodiments, each $R^1$ is independently a long chain saturated or unsaturated aliphatic group having 8-22 carbon atoms or mixtures thereof. In certain embodiments, each $R^1$ is independently a long chain saturated or unsaturated aliphatic group having 12-22 carbon atoms or mixtures thereof. In certain embodiments, each $R^1$ is independently a long chain saturated or unsaturated aliphatic group having 14-18 carbon atoms. In certain embodiments, each $R^1$ is independently a long chain saturated alkyl group or mixtures thereof.

In the surfactants described above, in certain embodiments, $R^1$ includes 1 or 2 unsaturated carbon-carbon bonds. In certain embodiments, $R^1$ includes 1 unsaturated carbon-carbon bond.

In the surfactants described above, in certain embodiments, each $R^2$ is independently a divalent alkylene group having 2 to 4 carbon atoms. In certain embodiments, each $R^2$ is independently a divalent alkylene group having 2 to 3 carbon atoms. In certain embodiments, each $R^2$ is independently a divalent alkylene group having 2 carbon atoms.

In the surfactants described above, in certain embodiments, $R^3$ is methyl or ethyl. In certain embodiments, $R^3$ is methyl.

In the surfactants described above, in certain embodiments, $R^6$ is methyl or ethyl. In certain embodiments, $R^6$ is methyl.

In the surfactants described above, in certain embodiments, n is 1 to 4. In certain embodiments, n is 1 or 2. In certain embodiments, n is 1.

In the surfactants described above, in certain embodiments, the anion $X^-$ is selected from the group consisting of $I^-$, $Cl^-$, $Br^-$, $SO_4^-$, $PO_4^-$, $NO_3^-$, $CH_3COO^-$, $CH_3OSO_3^-$, $CF_3OSO_3^-$, alkyl sulfates, alkyl carbonates, and alkyl phosphates. In certain embodiments, the anion $X^-$ is selected from the group consisting of $I^-$, $Cl^-$, $Br^-$, $SO_4^-$, $PO_4^-$, $NO_3^-$, $CH_3COO^-$, $CH_3OSO_3^-$, and $CF_3SO_3^-$.

Various combinations of the listed groups can be incorporated into any one compound.

In certain embodiments, one or more esterquat and/or amidequat surfactants are present in a fluorochemical composition in an amount of greater than 3 wt-%, based on fluorinated solids (not including water and co-solvent). Preferably, one or more esterquat and/or amidequat surfactants are present in a fluorochemical composition in an amount of at least 5 wt-%, based on fluorinated solids. Preferably, one or more esterquat and/or amidequat surfactants are present in a fluorochemical composition in an amount of no more than 20 wt-%, based on fluorinated solids. Preferably, one or more esterquat and/or amidequat surfactants are present in a fluorochemical composition in an amount of no more than 10 wt-%, based on fluorinated solids.

Fluorochemical compositions of the present disclosure can also include conventional cationic, nonionic, and/or zwitterionic (i.e., amphoteric) surfactants (i.e., emulsifiers), as "secondary" surfactants, in addition to the esterquat and amidequat surfactants described herein.

In certain embodiments, however, the fluorochemical compositions do not include nonionic surfactants. In certain embodiments, one or more esterquat and/or amidequat surfactants are the only surfactants present in a fluorochemical composition of the present disclosure.

If used, suitable such secondary surfactants that are nonionic can have high or low HLB values, such as those available under the trade names TERGITOL, TWEEN, and the like. Suitable such secondary surfactants that are cationic include mono- or bi-tail ammonium salts. Suitable secondary surfactants that are amphoteric include cocobetaines, sulphobetaines, amine-oxides, and the like.

Fluorinated cationic and nonionic surfactants can be utilised in the final dispersion as co-surfactants, but in minimal amounts, since these surfactants are expensive and often give rise to foam during applications requiring a lot of mechanical mixing. Fluorionated co-surfactants can be used as effective wetting and spreading agents. Fluorosurfactants can be used in combination with fluorine-free surfactants, such as hydrocarbon surfactants, mentioned above. Such fluorosurfactants are, for example, available from 3M Co. under the brand name Novec Fluorosurfactants, for example FC-4430 and FC-4432, and from Du Pont, under the brand name Zonyl Fluorosurfactants, for example Zonyl FSK or Zonyl FSN.

Fluorinated compounds suitable for use with the esterquat and/or amidequat surfactants of the present disclosure include a wide variety of conventional fluorinated compounds. Suitable fluorinated compounds include fluorochemical esters and polyesters, fluorochemical urethanes and polyurethanes, fluorochemical blocked urethanes and polyurethanes, fluorochemical poly(meth)acrylates, and mixtures thereof. In particular, preferred fluorinated compounds have terminal perfluorinated aliphatic groups with 4 to 6 carbon atoms, such as $C_4F_9$- and $C_6F_{13}$-containing compounds.

The fluorochemical treatment compositions comprise aqueous dispersions, suspensions, emulsions, or solutions, or organic solvent (or organic solvent/water) solutions, dispersions, suspensions, or emulsions of one or more of fluorinated compounds. When applied as coatings, the fluorochemical compositions of the present disclosure impart oil and/or water-repellency properties to a wide variety of fibrous substrates. Preferably, fluorochemical treatment compositions of the present disclosure include water.

One or more fluorinated compounds can be dissolved, suspended, or dispersed in a variety of solvents to form fluorochemical treatment compositions suitable for coating onto a fibrous substrate. Generally, the solvent solutions can contain at least 0.1 percent, by weight non-volatile solids (based on the total weight of the components). Generally, the solvent-based compositions can contain no greater than 90 percent, and preferably no greater than 50 percent, by weight non-volatile solids (based on the total weight of the components). Aqueous dispersions, suspensions, emulsions, or solutions are generally preferred and generally contain a non-volatile solids content of at least 0.1 percent, and preferably, 1 percent, by weight (based on the total weight of the components). Aqueous dispersions, suspensions, emulsions, or solutions are generally preferred and generally contain a non-volatile solids content of no greater than 50 percent, and preferably, no greater than 40 percent, by weight (based on the total weight of the components). Suitable solvents include water and organic solvents such as alcohols, esters, glycol ethers, amides, ketones, hydrocarbons, hydrofluorocarbons, hydrofluoroethers, chlorohydrocarbons, chlorocarbons, and mixtures thereof. Depending upon the fibrous substrate to which the composition is being applied, water is the preferred solvent due to environmental concerns.

In certain embodiments, co-solvents such as ethylene glycol, propylene glycol, dipropylene glycols, and dipropylene glycol ethers (e.g., dipropylene glycol monomethylether), are included, particularly for freeze protection. Preferably, a co-solvent is present in an amount of at least 5 wt-%, based on the total weight of the composition. Preferably, a co-solvent is present in an amount of no greater than 30 wt-%, and more preferably no greater than 10 wt-%, based on the total weight of the composition. A fluorochemical treatment composition containing one or more fluorinated compounds and one or more esterquat or amidequat surfactants as described in the present disclosure is preferably used as an aqueous composition, in particular an aqueous dispersion in water. If the fluorinated compound is made by a reaction in an organic solvent, for example, solution polymerization, it can be dispersed in water through vigorously mixing the compound in the presence of the surfactant and subsequent homogenization, for example, by a Manton Gaulin homogenizer or untrasound homogenizer. An organic solvent-free dispersion can be obtained by subsequent distillation of any reaction solvent.

To prepare the aqueous dispersions, a fluorinated compound, together with one or more esterquat or amidequat surfactants, and, if appropriate, other auxiliaries and solvents, are vigorously dispersed in water, a relatively large amount of energy being supplied. To facilitate the preparation of the dispersion, a fluorinated compound may be dissolved first in solvent or mixture of solvents, and the dispersion is advantageously carried out in two separate steps, predispersion being carried out first, followed by fine dispersion. Predispersion can also be carried out by using high shearing forces, for example, by using a high-speed stirrer, such as a dispersing machine of the ULTRATURAX type, and the predispersion thereby obtained is then subjected, for example, to ultrasonic treatment or treatment in a high pressure homogenizer. After this treatment, the particle size in the dispersion generally will be equal to or less than 1 micron (μm) to the extent of more than 80%, preferably to the extent of more than 90%. Preferably the average particle size is below 200 nanometers, even more preferably below 150 nanometers, or even below 120 nanometers. Generally, the aqueous dispersion as a concentrate contains 5% to 50% by weight of an active composition (one or more fluorinated compounds), 0.5% to 15% by weight of one or more surfactants, and 0 to 30% by weight of a co-solvent or co-solvent mixture, the remainder being water. Organic solvent-free dispersions can be prepared by removing the solvent by distillation.

Mixtures of water-insoluble solvents with water-soluble solvents can be employed as the solvent for preparation of the dispersion, the amount of the water-insoluble solvent in most cases being greater than the water-soluble solvent. Suitable water-soluble solvents are, for example, mono- or di-alcohols, lower ketones, polyglycol esters, and polyglycol ethers, or mixtures of such solvents. Examples of water-insoluble solvents are esters, ethers, and higher ketones. Low-boiling solvent portions can be removed by, for example, distillation, at a later time, if desired. Preferred water-insoluble solvents are esters or ketones, such as ethyl acetate, butyl acetate, and methyl ethyl ketone.

The amount of the fluorochemical composition applied to a fibrous substrate in accordance with this disclosure is chosen so that sufficiently high or desirable water and/or oil repellencies are imparted to the substrate surface, said amount usually being such that 0.01% to 5% by weight, preferably 0.05% to 2% by weight, of fluorinated compound is present on the treated substrate. The amount which is sufficient to impart desired repellency can be determined empirically and can be increased as necessary or desired.

Another embodiment of the present disclosure is an article having a cured coating derived from the fluorochemical composition of the present disclosure and optionally a co-solvent. After application and curing of the coating composition, the article exhibits durable oil- and/or water-repellency. The coating compositions of the present disclosure can be applied to a wide variety of fibrous substrates. Fibrous substrates include woven, knit, and nonwoven fabrics, textiles, carpets, leather, and paper.

Fibrous substrates are capable of imbibing a liquid and are therefore porous. Preferred substrates are textiles such as cotton, wool, polyester, nylon, and blends thereof. Particularly preferred substrates are synthetic textiles. Such substrates are particularly subject to staining and soiling, but also benefit greatly from the fluorochemical compositions of the present disclosure because the coating composition can penetrate into the fibrous or porous substrate surface and spread over the internal surfaces of the substrate. Preferred fibrous substrates that can be coated with the coating composition of the present disclosure are nonwoven, knits, and woven fabrics, carpet, drapery material, upholstery, clothing and essentially any textile. The fibrous substrate can be in the form of a yarn, toe, web, or roving, or in the form of fabricated textiles such as carpets, woven and nonwoven fabrics, etc.

To impart one or more repellency characteristics to a fibrous substrate, having one or more surfaces, (a) the coating composition is applied onto one or more surfaces of the substrate and (b) the coating composition is cured (e.g., dried) at ambient or room temperature or preferably at elevated temperatures. The use of elevated temperatures is particularly advantageous for curing fibrous substrates, since best repellency properties are then achieved. Elevated temperatures of at least 50° C. are preferred with at least 100° C. more preferred. Curing temperatures are typically no more than 200° C., and often no more than 170° C.

The coating compositions comprising the fluorochemical composition can be applied to a treatable substrate by standard methods such as, for example, spraying, padding, foaming, dipping, roll coating, brushing, or exhaustion (optionally followed by the drying of the treated substrate to remove any remaining water or co-solvent). When coating flat substrates of appropriate size, knife-coating or bar-coating may be used to ensure uniform coatings of the substrate. If desired, the fluorochemical composition can be co-applied with conventional fiber treating agents, for example, spin finishes or fiber lubricants. Such a topical treatment process can involve the use of the neat fluorochemical composition, without added co-solvent, and is thus preferred from an environmental perspective over the use of organic solvent solutions of the fluorochemical composition.

Additionally, the compositions of the disclosure may also include other fluorinated or non-fluorinated repellent materials, softeners, anti stats, anti dust mite or anti microbial additives.

ILLUSTRATIVE EMBODIMENTS

1. A fluorochemical composition comprising:
   at least one fluorinated compound; and
   greater than 3 wt-%, based on fluorinated solids, of at least one surfactant having the following formula (Formula I):

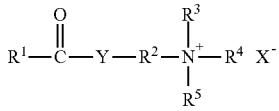

wherein:
   each $R^1$ is independently a long chain, linear or branched, saturated or unsaturated, aliphatic group having 6 to 24 carbon atoms;
   each $R^2$ is independently a divalent alkylene group having 1 to 4 carbon atoms;
   $R^3$ is an alkyl group having 1 to 4 carbon atoms;
   $R^4$ and $R^5$ are each independently —$CH_2C(O)OH$, —$CH_2CH_2OH$, —$(R^2O)_n$—H, an alkyl group having 1 to 4 carbon atoms, or —$R^2$—Y—C(O)—$R^1$, with the proviso that only one of $R^4$ or $R^5$ can be —$R^2$—Y—C(O)—$R^1$ in any one compound;
   each Y is independently O or NH;
   n is 1-10; and
   $X^-$ is an anion.
2. The fluorochemical composition of embodiment 1 wherein the at least one surfactant has the following formula (Formula II):

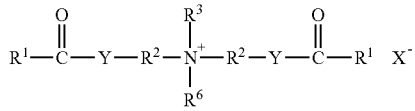

wherein:
   each $R^1$ is independently a long chain, linear or branched, saturated or unsaturated, aliphatic group having 6 to 24 carbon atoms;
   each $R^2$ is independently a divalent alkylene group having 1 to 4 carbon atoms;
   $R^3$ is an alkyl group having 1 to 4 carbon atoms;
   $R^6$ is an alkyl group having 1 to 4 carbon atoms or —$(R^2O)_n$—H;
   each Y is independently O or NH;
   n is 1-10; and
   $X^-$ is an anion.
3. The fluorochemical composition of embodiment 1 or 2 wherein each $R^1$ is independently a long chain saturated or unsaturated aliphatic group having 12-22 carbon atoms.
4. The fluorochemical composition of embodiment 3 wherein each $R^1$ is independently a long chain saturated or unsaturated aliphatic group having 14-18 carbon atoms.
5. The fluorochemical composition of any one of the previous embodiments wherein each $R^1$ is independently a long chain saturated alkyl group.
6. The fluorochemical composition of any one of the previous embodiments wherein each $R^2$ is independently a divalent alkylene group having 2 to 4 carbon atoms.
7. The fluorochemical composition of embodiment 6 wherein each $R^2$ is independently a divalent alkylene group having 2 to 3 carbon atoms.
8. The fluorochemical composition of embodiment 7 wherein each $R^2$ is independently a divalent alkylene group having 2 carbon atoms.

9. The fluorochemical composition of any one of the previous embodiments wherein $R^3$ is methyl or ethyl.
10. The fluorochemical composition of embodiment 9 wherein $R^3$ is methyl.
11. The fluorochemical composition of any one of the previous embodiments wherein n is 1.
12. The fluorochemical composition of any one of the previous embodiments wherein each $X^-$ is selected from the group consisting of $I^-$, $Cl^-$, $Br^-$, $SO_4^-$, $PO_4^-$, $NO_3^-$, $CH_3Coo^-$, $CH_3OSO_3^-$, $CF_3OSO_3^-$, alkyl sulfates, alkyl carbonates, and alkyl phosphates.
13. The fluorochemical composition of embodiment 12 wherein each $X^-$ is selected from the group consisting of $I^-$, $Cl^-$, $Br^-$, $SO_4^-$, $PO_4^-$, $NO_3^-$, $CH_3Coo^-$, $CH_3OSO_3^-$, and $CF_3OSO_3^-$.
14. The fluorochemical composition of any one of embodiments 1 thorugh 13 wherein Y is O.
15. The fluorochemical composition of any one of embodiments 1 through 13 wherein Y is NH.
16. The fluorochemical composition of any one of the previous embodiments wherein the surfactant is present in an amount of no more than 20 wt-%, based on the total weight of the fluorochemical solids of the composition.
17. The fluorochemical composition of any one of the previous embodiments wherein the surfactant is present in an amount of 5-10 wt-%, based on the total weight of the fluorochemical solids of the composition.
18. The fluorochemical composition of any one of the previous embodiments further comprising water.
19. The fluorochemical composition of any one of the previous embodiments further comprising a co-solvent.
20. The fluorochemical composition of embodiment 19 wherein the co-solvent is present in an amount of 5-10 wt-%, based on the total weight of the composition.
21. The fluorochemical composition of embodiment 19 wherein the co-solvent is selected from the group consisting of propylene glycol, ethylene glycol, dipropylene glycols, dipropylene glycol ethers, and mixtures thereof.
22. The fluorochemical composition of any one of the previous embodiments further comprising one or more other surfactants selected from the group consisting of cationic surfactants, nonionic surfactants, and combinations thereof.
23. The fluorochemical composition of any one of the previous embodiments wherein the fluorinated compound is selected from the group consisting of fluorochemical esters and polyesters, fluorochemical urethanes and polyurethanes, fluorochemical blocked urethanes and polyurethanes, fluorochemical poly (meth)acrylates, and mixtures thereof.
24. The fluorochemical composition of embodiment 23 wherein the fluorinated compound includes a $C_4F_9$- or $C_6F_{13}$-containing group.
25. A fluorochemical composition comprising:
at least one fluorinated compound; and
at least one surfactant having the following formula (Formula I):

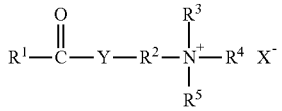

wherein:

each $R^1$ is independently a long chain, linear or branched, saturated or unsaturated, aliphatic group having 6 to 24 carbon atoms;

each $R^2$ is independently a divalent alkylene group having 1 to 4 carbon atoms;

$R^3$ is an alkyl group having 1 to 4 carbon atoms;

$R^4$ and $R^5$ are each independently —$CH_2C(O)OH$, —$CH_2CH_2OH$, —$(R^2O)_n$—H, an alkyl group having 1 to 4 carbon atoms, or —$R^2$—Y—C(O)—$R^1$, with the proviso that only one of $R^4$ or $R^5$ can be —$R^2$—Y—C(O)—$R^1$ in any one compound;

each Y is independently O or NH;

n is 1-10; and $X^-$ is an anion;

with the proviso that no nonionic surfactants are present in the composition.

26. The fluorochemical composition of embodiment 25 wherein the at least one surfactant has the following formula (Formula II):

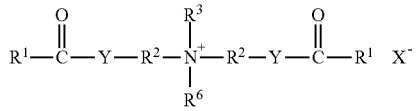

wherein:

each $R^1$ is independently a long chain, linear or branched, saturated or unsaturated, aliphatic group having 6 to 24 carbon atoms;

each $R^2$ is independently a divalent alkylene group having 1 to 4 carbon atoms;

$R^3$ is an alkyl group having 1 to 4 carbon atoms;

$R^6$ is an alkyl group having 1 to 4 carbon atoms or —$(R^2O)_n$—H;

each Y is independently O or NH;

n is 1-10; and $X^-$ is an anion.

27. The fluorochemical composition of embodiment 25 or 26 wherein the surfactant of Formula I or Formula II is the only surfactant present in the composition.
28. A method of imparting repellency to a fibrous substrate having one or more surfaces, the method comprising:
applying a fluorochemical treatment composition onto one or more surfaces of the fibrous substrate; and
curing the fluorochemical treatment composition;
wherein the fluorochemical treatment composition comprises a fluorochemical composition as described in any one of the preceding embodiments.
29. An article comprising:
a fibrous substrate having one or more surfaces treated according to the method of embodiment 28.

EXAMPLES

Materials utilized for the examples are shown in Table 1.

TABLE 1

Materials List

| Material | Description | Source |
|---|---|---|
| MeFBSEMA | N-methyl perfluorobutylsulphonamidoethyl-methacrylate | See Example 1A and Example 2, sections A, B, and C in U.S. Pat. No. 6,664,354 |
| 2-mercaptoethanol | 2-Mercaptoethanol | Sigma-Aldrich, Belgium |
| V-50 | 2,2'-Azobis(2-methylpropionamidine) dihydrochloride | Sigma-Aldrich, St. Louis, MO |
| V-59 | 2,2'-Azodi(2-methylbutyronitrile) | Wako Pure Chemical Industries, Lts., Germany |
| SA | Stearylalcohol | Sigma-Aldrich, Belgium |
| UNILIN 350 | Fully saturated, long chain, linear primary alcohol, OH equivalent of 434 | Baker Hughes, Houston, TX |
| PAPI | Voronate M 220, Low Viscosity Polymethylene Polyphenylisocyanate | Dow Chemical, Netherlands |
| DBTDL | Dibutyltin dilaurate | Sigma-Aldrich, Belgium |
| MEKO | 2-Butanoneoxime | Sigma-Aldrich, Belgium |
| VGH-70 | ARMOCARE VGH-70, Dipalmitoylethyldimethyl ammonium chloride | AkzoNobel, Netherlands |
| ACCOSOFT 440 | Methyl bis(hydrogenated tallow amidoethyl)-2-hydroxyethyl ammonium methyl sulfate | Stepan Company, Northfield, IL |
| ODA | Octadecylacrylate | Sigma-Aldrich, St. Louis, MO |
| Octadecanedioic acid | $HOOC(CH_2)_{16}COOH$ | Sigma-Aldrich, St. Louis, MO |
| ARQUAD 12-50 | 1-Dodecanaminium,n,n,n,n-trimethyl-, chloride | Akzo Nobel, Chicago, IL |
| ARQUAD 18-50 | 1-Octadecanaminium,n,n,n,n-trimethyl-, chloride | Akzo Nobel, Chicago, IL |
| ARQUAD 2HT-75 | Dimethyldioctadecylammonium chloride | Akzo Nobel, Chicago, IL |
| ETHOQUAD C-12 | Quaternary ammonium compounds, coco alkylbis(hydroxyethyl)methyl, chlorides | Akzo Nobel, Chicago, IL |
| Polyester | Polyester fabric | Chyang Sheng Dyeing and Finishing Company Ltd., Taiwan |
| Polyamide | Polyamide fabric, style 6145 | Sofinal NV, Belgium |
| Nylon | Sand nylon fabric | Burlington Worldwide, Greensboro, NC |
| TMN-6 | TERGITOL TMN-6, Polyethyleneglycoltrimethylnonylether, nonionic with 8 mole EO and HLB of 13.1 | Dow Chemical, Netherlands |
| 15-S-30 | TERGITOL 15-S-30, Secondary alcohol ethoxylate, nonionic with 31 moles EO and HLB of 17.4 | Dow Chemical, Netherlands |
| C6 Telomer MA | $C_6F_{13}CH_2CH_2OC(O)C(CH_3)=CH_2$ | ABCR, Germany |

Test Methods

Oil Repellency (OR)

The oil repellency of a treated substrate is measured by the American Association of Textile Chemists and Colorists (AATCC) Standard Test Method No 118-1983, which is based on the resistance of a treated substrate to penetration by oils of varying surface tensions (see U.S. Pat. No. 5,910,557). Ratings from 1 to 8 were assigned, with higher values indicating better oil repellency.

Spray Rating (SR)

The spray rating of a treated substrate is a value indicative of the dynamic repellency of the treated substrate to water that impinges on the treated substrate. The repellency is measured by Test Method 22-1996, published in the 2001 Technical Manual of the American Association of Textile Chemists and Colorists (AATCC), and is expressed in terms of a 'spray rating' of the tested substrate. The spray rating is obtained by spraying 250 ml water on the substrate from a height of 15 cm. The welting pattern is visually rated using a 0 to 100 scale, where 0 means complete wetting and 100 means no wetting at all.

Spray rating is measured initially and after the treated fabric is laundered 5 times. The laundering procedure consisted of placing a 400-900 $cm^2$ sheet of treated substrate in a washing machine (Miele Novotronic T490) along with ballast sample (1.9 kg of 8 oz fabric). A commercial detergent ("Sapton", available from Henkel, Germany, 46 g) is added. The substrate and ballast load are washed using a short wash cycle at 40° C., followed by a rinse cycle and centrifuging. The sample is not dried between repeat cycles. After 5 cycles, the substrate is hung on a support and dried at room temperature (about 20° C.) for 4 hours. After drying, the samples are pressed using an iron at 160° C. for 15 seconds.

Bundesmann

The impregnating effect of rain on treated substrates is determined using the Bundesmann Test Method (DIN 53888). In this test, the treated substrates were subjected to a simulated rainfall, while the back of the substrate is rubbed. The appearance of the upper, exposed surface is checked visually after 1, 5, and 10 minutes and is given a rating between 1 (complete surface wetting) and 5 (no water remains on the surface).

Sediment

A test dispersion (100 ml) is poured in a graduated and calibrated centrifugation cell. The sample is centrifuged for 15 minutes at 2200 rpm in a ALC 4233 ECT centrifuge (Analis, Belgium). The emulsion is poured out and the sediment remaining in the cell is measured. Percent sediment is reported.

Particle Size

The dispersion particle size is determined by dynamic light scattering with a Nicomp Submicron Autodilute C370 particle sizer (Nicomp, Santa Barbara, Calif.). The dispersion is diluted and inserted in a small measuring tube until the intensity of the scattered light is 300 kHz. The intensity weight particle size is measured. The average particle size in nanometers is recorded.

Mechanical Stability

The test dispersion (80 grams) is accurately weighed into 125 ml bottle. The bottle is closed, sealed, and put horizontally on a lab shaker with an amplitude of 2.5 cm and a speed of 200 rpm. After 24 hours the content of the bottle is poured through a cheese cloth with a pore size of 350 microns into a tared glass bottle of 125 ml. The filtrate is weighted accurately to 0.01 gram. The mechanical stability is expressed as: %=(weight of the filtrate*100)/initial weight.

Examples

Fluorochemical Ester Oligomer (Examples 1-5, Comparatives 1-8)

a. Example 1 (E-1)

Fluorochemical ester oligomer was prepared from octadecanedioic acid as described in WO2008/154421 (page 51, Test Materials A Ester Oligomers).

The ester oligomer (40 g) was dispersed by first dissolving them in MIBK (80 g) and heating to 65° C. To this was added a mixture of water (180 g) and surfactant (5 wt % based on solids) at 65° C. They were allowed to mix before passing two times through a Microfluidizer (HC8000, Microfluidics, Newton, Mass.). The MIBK was evaporated under reduced pressure using a *Buchi* Rotaevaporater (*BUCHI* Corporation New Castle, Del.). This is Example 1 (E–1).

b. Examples 2-5 (E-2 to E-5)

E-2 through E-5 were prepared per Example 1 with the surfactant system listed in Tables 2 and 3.

Fluorochemical Methacrylate (Examples 6-9, Comparatives 9-14)

Examples 6-9 and Comparatives 9-14 were prepared according to the general procedure outlined for Example 6: In a 125 ml glass bottle was placed 15 g of MeFBSEMA, 5 g ODA, 60 g water, 10 g acetone, 1 g surfactant (5 wt % based on solids), and 0.1 g V-50. Nitrogen was passed through this solution for 5 minutes. The bottle was sealed and heated at 70° C. for 15 hours. The acetone was then distilled off under vacuum to obtain an aqueous dispersion.

Fluorochemical Urethanes (Examples 10-17, Comparatives 15-18))

a. Example 10

Oligomerization

In a three necked flask fitted with a stirrer, heating mantle, thermometer, and cooler, were placed 1000 g (2.4 equivalent) of MeFBSEMA, 15.3 g (0.2 equivalent) 2-mercaptoethanol, and 338.4 g ethylacetate. The mixture was heated to 40° C. under nitrogen and degassed with vacuum. To this flask was added 2.55 g V-59 initiator and the mixture was heated to about 75° C. for 3 hours. A second aliquot of 2.55 g V-59 initiator was then added to the flask and heating was continued under nitrogen for 16 hours. A third charge of 2.55 g V-59 was then added and the reaction continued for 8 hours. A clear, viscous solution of oligomeric fluorochemical alcohol was obtained at 75% solids.

Urethane Reaction

In a three necked flask fitted with a stirrer, heating mantle, thermometer, and cooler were placed 1353.7 g (0.2 equivalent) of the oligomeric fluorochemical alcohol, 53 g (0.2 equivalent) SA, and 1537 g ethylacetate. About 100 g ethylacetate were distilled off, and the flask cooled to about 40° C. under nitrogen. To this flask were then added 133.3 g (0.98 equivalent) PAPI and 2.5 g DBTDL and the mixture was heated to 80° C. under nitrogen for 8 hours. To this was then added 48.3 g (0.55 equivalent) MEKO blocking agent and the reaction continued for 2 hours. A clear urethane solution was obtained.

Emulsification

In a three necked flask were placed 3125.3 g of the clear urethane solution and ethylacetate (40% solids). The solution was heated to about 70° C. In a second 3-necked flask were placed 2730 g deionized water, 354 g propyleneglycol, and 125 g VGH-70 (7 wt % based on solids). This mixture was heated to about 70° C. The hot water phase was then added to the hot ethylacetate phase and mixed vigourously for about 30 minutes, until a stable pre-emulsion was formed. This hot pre-emulsion was then passed twice through a heated Manton-Gaulin homogenizer (Lab 60, APV Belgium, Diegem, Belgium) at 300 bar and about 67° C. A thick liquid was obtained. Ethylacetate was stripped from the emulsion at about 50-60° C. and reduced pressure of about 30 mm Hg to obtain an aqueous dispersion at about 30% solids. The dispersion was filtered through a 100 micron polypropylene filter bag. The average particle size was about 90-110 nm.

b. Examples 11-17

Examples 11-17 were prepared as Example 10 with the monomers and surfactants shown in Tables 5-7.

Comparatives

Comparative dispersions utilized commonly-used fabric treatment surfactants and were prepared as described in Tables 2-7.

Results

The Examples and Comparatives were coated on fabric using a pad application technique at approximately 0.3% SOF (solids on fabric) and cured for 2 minutes at 170° C. The dispersion compositions, fabric test results, and stability data are shown in Tables 2-7.

Test results for fabric treated with fluorochemical ester dispersions are shown in Table 2. Equivalent, and in some cases improved, results are observed with the surfactants containing a tallow group.

TABLE 2

Fabric Treated with Fluorochemical Ester Oligomer Dispersions

| Example | Fabric | Surfactant (5%) | OR | SR |
|---|---|---|---|---|
| E-1 | Nylon | ACCOSOFT 440 | 0 | 50 |
| E-2 | Nylon | VGH-70 | 0 | 100 |
| E-3 | Polyester | ACCOSOFT 440 | 4 | 100 |
| E-4 | Polyester | VGH-70 | 4 | 100 |

TABLE 2-continued

| Fabric Treated with Fluorochemical Ester Oligomer Dispersions | | | | |
|---|---|---|---|---|
| | Fabric | Surfactant (5%) | OR | SR |
| Comparative | | | | |
| C-1 | Nylon | ARQUAD 12-50 | 0 | 70 |
| C-2 | Nylon | ARQUAD 18-50 | 0 | 50 |
| C-3 | Nylon | ARQUAD 2HT-75 | 0 | 100 |
| C-4 | Polyester | ARQUAD 12-50 | 2 | 80 |
| C-5 | Polyester | ARQUAD 18-50 | 2 | 75 |
| C-6 | Polyester | ARQUAD 2HT-75 | 3 | 100 |

The fluorochemical ester utilized in Examples 1-4 was emulsified with VGH-70 and two non-tallow containing systems and tested for stability. As shown in Table 3, a more stable emulsion is produced with the VGH surfactant system.

TABLE 3

| Stability of Fluorochemical Ester Oligomer Dispersions | | | | |
|---|---|---|---|---|
| | Surfactant | Particle Size (nm) | Sediment (%) | Mechanical Stability (%) |
| Example | | | | |
| E-5 | 7% VGH-70 | 96 | 0.1 | 98 |
| Comparative | | | | |
| C-7 | 7% ETHOQUAD C-12 | 110 | 0.2 | 96 |
| C-8 | 6% TMN-6/ 6.3% 15-S-30/ 2.7% ETHOQUAD C-12 | 115 | 0.2 | 96 |

Test results for fabric treated with fluorochemical methacrylate dispersion are shown in Table 4. Equivalent, and in most cases improved, results are observed with the surfactants containing a tallow group.

TABLE 4

| Fabric Treated with Fluorochemical Methacrylate Dispersions | | | | |
|---|---|---|---|---|
| | Fabric | Surfactant (5%) | OR | SR |
| Example | | | | |
| E-6 | Nylon | ACCOSOFT 440 | 0 | 100 |
| E-7 | Nylon | VGH-70 | 0 | 100 |
| E-8 | Polyester | ACCOSOFT 440 | 2 | 100 |
| E-9 | Polyester | VGH-70 | 2 | 100 |
| Comparative | | | | |
| C-9 | Nylon | ARQUAD 12-50 | 0 | 50 |
| C-10 | Nylon | ARQUAD 18-50 | 1 | 95 |
| C-11 | Nylon | ARQUAD 2HT-75 | 0 | 100 |
| C-12 | Polyester | ARQUAD 12-50 | 0 | 50 |
| C-13 | Polyester | ARQUAD 18-50 | 1 | 70 |
| C-14 | Polyester | ARQUAD 2HT-75 | 2 | 100 |

Test results for polyester and polyamide fabric treated with fluorochemical urethane dispersions with VGH-70 surfactant are shown in Tables 5 and 6, respectively. Improved results are observed with the surfactants containing a tallow group.

TABLE 5

| Polyester Treated with Fluorochemical Urethane Emulsions | | | | | |
|---|---|---|---|---|---|
| | Fluorochemical Urethane (Equivalent Ratio[a]) | Surfactant | Bundesmann | SR (initial) | SR (5 Cycles) |
| Example | | | | | |
| E-10 | 0.6/0.6/3/1.8 | 7% VGH-70 | 5-5-4 | 100 | 100 |
| E-11 | 1/1/3/1 | 7% VGH-70 | 5-5-4 | 100 | 100 |
| E-12 | 0.6/0.6/3/1.8 [b] | 7% VGH-70 | 5-5-5 | 100 | 100 |
| E-13 | 0.5/1/3/1.5 [c] | 7% VGH-70 | 4-3-1 | 100 | 80 |
| Comparitive | | | | | |
| C-15 | 0.5/1/3/1.5 [c] | 6% TMN-6/ 3% ETHOQUAD C-12/ 2% 15-S-30 | 3-1-1 | 100 | 80 |

[a]Equivalents MA12/SA/PAPI/MEKO;
[b] C6 Telomer MA was used instead of MeFBSEMA;
[c] UNILIN 350 used in place of SA

TABLE 6

| Polyamide Treated with Fluorochemical Urethane Emulsions | | | | | |
|---|---|---|---|---|---|
| | Fluorochemical Urethane (Equivalent Ratio[a]) | Surfactant | Bundesmann | SR (initial) | SR (5 Cycles) |
| Example | | | | | |
| E-14 | 0.5/1/3/1.5 [b] | 7% VGH-70 | 3-1-1 | 100 | 70 |
| E-15 | 0.6/0.6/3/1.8 | 7% VGH-70 | 3-1-1 | 100 | 70 |

TABLE 6-continued

| Polyamide Treated with Fluorochemical Urethane Emulsions | | | | | |
|---|---|---|---|---|---|
| | Fluorochemical Urethane (Equivalent Ratio[a]) | Surfactant | Bundesmann | SR (initial) | SR (5 Cycles) |
| Comparitive | | | | | |
| C-16 | 0.5/1/3/1.5 [b] | 6% TMN-6/ 3% ETHOQUAD C-12/ 2% 15-S-30 | 1-1-1 | 100 | 0 |

[a]Equivalents MA12/SA/PAPI/MEKO;
[b] UNILIN 350 used in place of SA

Fluorochemical urethanes were emulsified with VGH and two non-tallow containing systems and tested for stability. As shown in Table 7, a more stable emulsion is produced with the VGH surfactant system.

TABLE 7

| Stability of Fluorochemical Urethane Dispersion | | | | | |
|---|---|---|---|---|---|
| | Fluorochemical Urethane (Equivalent Ratio[a]) | Surfactant | Particle Size (nm) | Sediment (%) | Mechanical Stability (%) |
| Example | | | | | |
| E-16 | 0.6/0.6/3/1.8 | 7% VGH-70 | 92 | 0 | 98 |
| E-17 | 0.6/0.6/3/1.8 [b] | 7% VGH-70 | 90 | 0 | 98 |
| Comparative | | | | | |
| C-17 | 0.6/0.6/3/1.8 | 7% ETHOQUAD C-12 | 104 | 0.2 | 98 |
| C-18 | 0.6/0.6/3/1.8 | 6% TMN-6/ 3% ETHOQUAD C-12/ 2% 15-S-30 | 108 | 0.2 | 98 |

[a]Equivalents MA12/SA/PAPI/MEKO;
[b] C6 Telomer MA was used instead of MeFBSEMA The complete disclosures of the patents, patent documents, and publications cited herein are incorporated by reference in their entirety as if each were individually incorporated. Various modifications and alterations to this disclosure will become apparent to those skilled in the art without departing from the scope and spirit of this disclosure. It should be understood that this disclosure is not intended to be unduly limited by the illustrative embodiments and examples set forth herein and that such examples and embodiments are presented by way of example only with the scope of the disclosure intended to be limited only by the claims set forth herein as follows.

What is claimed is:

1. A method of imparting oil and/or water repellency to a fibrous substrate having one or more surfaces, the method comprising:

applying an aqueous fluorochemical treatment composition onto one or more surfaces of the fibrous substrate; and curing the fluorochemical treatment composition at a temperature of greater than 100° C. and no more than 200° C.;

wherein the aqueous fluorochemical treatment composition comprises:

at least one fluorinated compound selected from the group consisting of fluorochemical urethanes and polyurethanes, fluorochemical blocked urethanes and polyurethanes, fluorochemical poly(meth)acrylates, and mixtures thereof; and greater than 3 wt-% and up to 20 wt-%, based on fluorinated solids, of at least one surfactant having the following formula (Formula II):

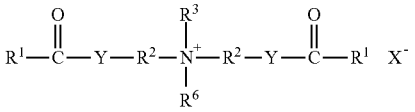

wherein:

each $R^1$ is independently a long chain, linear or branched, saturated, aliphatic group having 6 to 24 carbon atoms;

each $R^2$ is independently a divalent alkylene group having 1 to 4 carbon atoms;

$R^3$ is an alkyl group having 1 to 4 carbon atoms;

$R^6$ is an alkyl group having 1 to 4 carbon atoms or $—(R^2O)_n—H$;

each Y is O;

n is 1-10; and $X^-$ is an anion;

wherein the composition is in the form of an aqueous dispersion having an average particle size of below 200 nanometers;

wherein the composition has a sediment level of 0.1% by weight or less; and wherein when the fibrous substrate is a polyester fibrous substrate, and after applying and curing the fluorochemical treatment onto the polyester fibrous substrate, the polyester fibrous substrate has:

a Bundesmann of at least 4-3-1; and an initial Spray Rating of at least 100; and a Spray Rating of at least 80 after 5 launderings.

2. An article comprising:

a fibrous substrate having one or more surfaces treated according to the method of claim 1.

3. A method of imparting oil and/or water repellency to a fibrous substrate having one or more surfaces, the method comprising:

applying an aqueous fluorochemical treatment composition onto one or more surfaces of the fibrous substrate; and curing the fluorochemical treatment composition at a temperature of 170° C. to 200° C.;

wherein the fluorochemical treatment composition comprises:

at least one fluorinated compound selected from the group consisting of fluorochemical urethanes and polyurethanes, fluorochemical blocked urethanes and polyurethanes, fluorochemical poly(meth)acrylates, and mixtures thereof; and greater than 3 wt-% and up to 20 wt-%, based on fluorinated solids, of at least one surfactant having the following formula (Formula I):

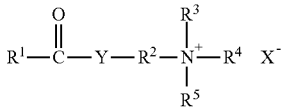

wherein:

each $R^1$is independently a long chain, linear or branched, saturated or unsaturated, aliphatic group having 6 to 24 carbon atoms;

each $R^2$ is independently a divalent alkylene group having 1 to 4 carbon atoms;

$R^3$ is an alkyl group having 1 to 4 carbon atoms;

$R^4$ and $R^5$ are each independently —$CH_2C(O)OH$, —$CH_2CH_2OH$, —$(R^2O)_n$—H, an alkyl group having 1 to 4 carbon atoms, or —$R^2$—Y—C(O)—$R^1$, with the proviso that only one of $R^4$ or $R^5$ can be —$R^2$—Y—C(O)—$R^1$ in any one compound;

each Y is independently O or NH;

n is 1-10; and $X^-$ is an anion;

wherein the composition is in the form of an aqueous dispersion having an average particle size of below 200 nanometers; and wherein when the fibrous substrate is a polyester fibrous substrate, and after applying and curing the fluorochemical treatment onto the polyester fibrous substrate, the polyester fibrous substrate has:

a Bundesmann of at least 4-3-1; and an initial Spray Rating of at least 100; and a Spray Rating of at least 80 after 5 launderings.

4. The method of claim 3 wherein the at least one surfactant has the following formula (Formula II):

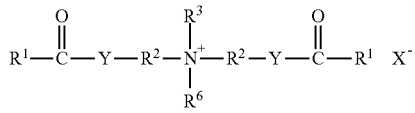

wherein:

each $R^1$ is independently a long chain, linear or branched, saturated, aliphatic group having 6 to 24 carbon atoms;

each $R^2$ is independently a divalent alkylene group having 1 to 4 carbon atoms;

$R^3$ is an alkyl group having 1 to 4 carbon atoms;

$R^6$ is an alkyl group having 1 to 4 carbon atoms or —$(R^2O)_n$—H;

each Y is independently O or NH;

n is 1-10; and $X^-$ is an anion.

5. The method of claim 3 wherein the surfactant is present in an amount of 5-10 wt-%, based on fluorinated solids.

6. The method of claim 3 further comprising a co-solvent.

7. The method of claim 3 further comprising one or more other surfactants selected from the group consisting of cationic surfactants, nonionic surfactants, and combinations thereof.

8. The method of claim 3 wherein the fluorinated compound includes a $C_4F_9$- or $C_6F_{13}$-containing group.

9. The method of claim 3 wherein the surfactant of Formula I is the only surfactant present in the composition.

10. A method of imparting oil and/or water repellency to a fibrous substrate having one or more surfaces, the method comprising:

applying an aqueous fluorochemical treatment composition onto one or more surfaces of the fibrous substrate; and curing the fluorochemical treatment composition at a temperature of greater than 100° C. and no more than 200° C.;

wherein the aqueous fluorochemical treatment composition comprises:

at least one fluorinated compound selected from the group consisting of fluorochemical urethanes and polyurethanes, fluorochemical blocked urethanes and polyurethanes, fluorochemical poly(meth)acrylates, and mixtures thereof; and greater than 3 wt-% and up to 20 wt-%, based on fluorinated solids, of at least one surfactant having the following formula (Formula II):

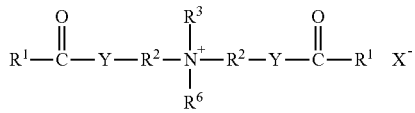

wherein:

each $R^1$ is independently a long chain, linear or branched, saturated, aliphatic group having 14 to 18 carbon atoms;

each $R^2$ is independently a divalent alkylene group having 2 carbon atoms;

$R^3$ is methyl;

$R^6$ is an alkyl group having 1 to 4 carbon atoms or $—(R^2O)_n—H$;

each Y is O;

n is 1; and $X^-$ is selected from the group consisting of $I^-$, $Cl^-$, $Br^-$, $SO_4^-$, $PO_4^-$, $NO_3^-$, $CH_3COO^-$, $CH_3OSO_3^-$, and $CF_3OSO_3^-$;

wherein the composition is in the form of an aqueous dispersion having an average particle size of below 200 nanometers;

wherein the composition has a sediment level of 0.1% by weight or less; and wherein when the fibrous substrate is a polyester fibrous substrate, and after applying and curing the fluorochemical treatment onto the polyester fibrous substrate, the polyester fibrous substrate has:

a Bundesmann of at least 4-3-1; and an initial Spray Rating of at least 100; and a Spray Rating of at least 80 after 5 launderings.

11. An article comprising:

a fibrous substrate having one or more surfaces treated according to the method of claim 10.

12. A method of imparting oil and/or water repellency to a fibrous substrate having one or more surfaces, the method comprising:

applying an aqueous fluorochemical treatment composition onto one or more surfaces of the fibrous substrate; and curing the fluorochemical treatment composition at a temperature of 170° C. to 200° C.;

wherein the fluorochemical treatment composition comprises:

at least one fluorinated compound selected from the group consisting of fluorochemical urethanes and polyurethanes, fluorochemical blocked urethanes and polyurethanes, fluorochemical poly(meth)acrylates, and mixtures thereof; and greater than 3 wt-% and up to 20 wt-%, based on fluorinated solids, of at least one surfactant having the following formula (Formula I):

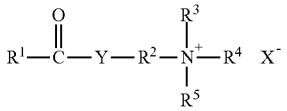

wherein:

each $R^1$ is independently a long chain, linear or branched, saturated or unsaturated, aliphatic group having 14 to 18 carbon atoms;

each $R^2$ is independently a divalent alkylene group having 2 carbon atoms;

$R^3$ is methyl;

$R^4$ and $R^5$ are each independently $—CH_2C(O)OH$, $—CH_2CH_2OH$, $—(R^2O)—H$, an alkyl group having 1 to 4 carbon atoms, or $—R^2—Y—C(O)—R^1$, with the proviso that only one of $R^4$ or $R^5$ can be $—R^2—Y—C(O)—R^1$ in any one compound;

Y is O;

n is 1; and $X^-$ is selected from the group consisting of $I^-$, $Cl^-$, $Br^-$, $SO_4^-$, $PO_4^-$, $NO_3^-$, $CH_3COO^-$, $CH_3$ $OSO_3^-$, and $CF_3OSO_3^-$;

wherein the composition is in the form of an aqueous dispersion having an average particle size of below 200 nanometers;

wherein the composition has a sediment level of 0.1% by weight or less; and wherein when the fibrous substrate is a polyester fibrous substrate, and after applying and curing the fluorochemical treatment onto the polyester fibrous substrate, the polyester fibrous substrate has:

a Bundesmann of at least 4-3-1; and an initial Spray Rating of at least 100; and a Spray Rating of at least 80 after 5 launderings.

13. An article comprising:

a fibrous substrate having one or more surfaces treated according to the method of claim 12.

14. The method of claim 8 wherein the flourinated urethane compound is a fluorochemical urethane or polyurethane.

15. The method of claim 14 wherein the fluorinated urethane compound is prepared from the reaction of N-methyl perfluorobutylsulphonamidoethyl-methacrylate (MeFBSEMA), stearyl alcohol (SA), polymethylene polyphenyleneisocyanate (PAPI) and 2-butanoneoxime (MEKO).

16. The method of claim 4 wherein each $R^1$ is independently a long chain saturated aliphatic group having 12-22 carbon atoms.

17. The method of claim 16 wherein each $R^1$ is independently a long chain saturated aliphatic group having 14-18 carbon atoms.

18. The method of claim 4 wherein each $R^1$ is independently a long chain saturated alkyl group.

19. The method of claim 4 wherein each $R^2$ is independently a divalent alkylene group having 2 to 4 carbon atoms.

20. The method of claim 19 wherein each $R^2$ is independently a divalent alkylene group having 2 to 3 carbon atoms.

21. The method of claim 20 wherein each $R^2$ is independently a divalent alkylene group having 2 carbon atoms.

22. The method of claim 4 wherein $R^3$ is methyl or ethyl.

23. The method of claim 22 wherein $R^3$ is methyl.

24. The method of claim 4 wherein n is 1.

25. The method of claim 4 wherein each $X^-$ is selected from the group consisting of $I^-Cl^-$, $Br^-$, $SO_4^-$, $PO_4^-$, $NO_3^-$, $CH_3COO^-$, $CH_3OSO_3^-$, $CF_3OSO_3^-$, alkyl sulfates, alkyl carbonates, and alkyl phosphates.

26. The method of claim 25 wherein each $X^-$ is selected from the group consisting of I, $Cl^-$, $Br^-$, $SO_4^-$, $PO_4^-$, $NO_3^-$, $CH_3COO^-$, $CH_3OSO_3^-$, and $CF_3OSO_3^-$.

27. The method of claim 4 wherein Y is O.

28. The method of claim 4 wherein Y is NH.

29. The method of claim 6 wherein the co-solvent is present in an amount of 5-10 wt-%, based on the total weight of the composition.

30. The method of claim 6 wherein the co-solvent is selected from the group consisting of propylene glycol, ethylene glycol, dipropylene glycols, dipropylene glycol ethers, and mixtures thereof.

* * * * *